United States Patent [19]

Ludlow

[11] 4,428,734

[45] Jan. 31, 1984

[54] PLANING-HULL TYPE BOATS AND POWER DRIVES THEREIN

[76] Inventor: Roy S. Ludlow, 1890 Millbrook Rd., Salt Lake City, Utah 84106

[21] Appl. No.: 900,577

[22] Filed: Apr. 27, 1978

[51] Int. Cl.[3] ..... B63H 23/08

[52] U.S. Cl. ..... 440/75; 440/79; 440/83

[58] Field of Search ..... 115/34 R, 34 B, 37, 115/38, 35; 74/710; 440/75, 79, 83

[56] References Cited

U.S. PATENT DOCUMENTS

| | | | |
|---|---|---|---|
| 1,701,403 | 2/1929 | Coykendall | 115/34 R X |
| 3,112,728 | 12/1983 | Krause | 115/37 |
| 3,128,742 | 4/1964 | Cameron | 440/75 X |
| 3,207,118 | 9/1965 | Baldwin | 115/37 |
| 3,422,790 | 1/1969 | Connell | 115/37 |
| 3,532,068 | 10/1970 | Lamburn | 440/75 |
| 3,572,281 | 3/1971 | Becker | 115/37 |
| 3,636,909 | 1/1972 | Benson, Jr. | 115/34 R |
| 3,765,041 | 10/1973 | Morse | 115/34 R X |
| 3,901,103 | 8/1975 | Hufstader | 74/710 |
| 3,922,997 | 12/1975 | Jameson | 440/75 |
| 3,924,557 | 12/1975 | Bloch | 115/38 |
| 3,962,985 | 6/1976 | Noguchi et al. | 115/37 X |

FOREIGN PATENT DOCUMENTS

| | | | |
|---|---|---|---|
| 1055280 | 1/1967 | United Kingdom | 115/37 |

*Primary Examiner*—Sherman Basinger
*Attorney, Agent, or Firm*—B. Deon Criddle

[57] ABSTRACT

A boat drive for boats having planing hulls. The boat drive includes a single prime mover or engine that drives, as an inboard drive, a pair of marine screws or propellers that are secured to respective shafts. The engine is located rearmost in the boat proximate the transom and has coupled thereto an automatic transmission having a control provided with two or three speeds forward, neutral and reverse positions, and a lock position. The output shaft from the transmission is coupled, as by a double U-joint structure, to power transfer device including for example, an automobile differential or the like and angle drives suitable for imparting rotation to mutually spaced propeller shafts. The boat incorporating the drive includes a planing-type hull, and controls are supplied the boat for throttling the engine and for selecting the speed ranges of the transmission. High torque, moderate rpm driving of the propeller, through rapid acceleration of the engine and low-range operation of the transmission, rapidly causes the boat to plane and subsequent shifting of the automatic transmission to a higher-range ratio, while simultaneously reducing engine speed, results in a cruising condition that minimizes fuel consumption.

3 Claims, 3 Drawing Figures

PLANING-HULL TYPE BOATS AND POWER DRIVES THEREIN

FIELD OF INVENTION

The present invention relates to boats having planing hulls and, more particularly, to power drives therein whereby a single engine, and multi-speed automatic transmission, are utilized in an inboard construction to drive a pair of output shafts having marine screws or propellers. The drive system is constructed to minimize the time required for the boat to assume a planing condition, and to do this with a minimum of fuel consumption. cruising conditions, at maximum fuel efficiency, are achieved by throttling down the engine and shifting the transmission to a higher range after the boat is on plane.

DESCRIPTION OF PRIOR ART

In the past, marine engines have been provided with a single, direct-drive control for going forward and reverse, at progressively increasing speeds without respective gear change, and for placing the control in a neutral position. When the engine is rapidly accelerated, the high rpm and relatively low torque of the propeller shaft causes a churning and slippage of the marine propeller in the water so as to reduce "bite" and cause a condition of excessive turbulence whereby substantial delay in the boat experiencing a planing condition is experienced. This is particularly disadvantageous to boats having planing hulls which are intended for racing, or for use by water skiers and so forth. Also, such a condition drastically increases fuel consumption. Finally, as to conventional boats, once a planing condition is achieved, engine speed must be very high in order to continue the boat in a cruising condition, all of which drastically increases fuel consumption. It will be apparent that the engine control for the boat in the forward-speed condition merely increases the flow of the fuel-air mixture through the carburetor and thus progressively increases output shaft speed without increasing torque.

Examples of plural output drives utilizing a single power source are shown in the following patents: U.S. Pat. Nos. 5,371; 2,371,013; 3,289,628; 3,922,997; 3,207,118; 3,207,119; 3,422,790.

The above patents, however, do not teach the use, in planing hull type boats, the drive system of the present invention, incorporating a single engine having its drive shaft coupled to an automatic transmission that has plural speed ranges and that is connected to drive plural marine propellers on respective, mutually spaced shafts. This latter feature by itself increases boat cruising speed by as much as one-fourth over a single-engine single-screw design. Such plural speed ranges are essential in order for the boat to assume, as rapidly as possible, a planing condition and, subsequently, a cruising speed condition wherein the speed of the engine can be throttled back and the automatic transmission speed range selected to an upper range. This permits a satisfactory cruising speed without racing the engine and thus lowering fuel efficiency.

Likewise, none of the prior art teaches the use of a single engine at the rear of and on a central axis of a planing type hull, in combination with an automatic transmission having plural speed ranges, a differential and right angle drives, to operate a pair of propellers through shafts extending from a location forwardly of the engine and transmission along opposite sides of the engine and transmission to the rear of the hull.

BRIEF DESCRIPTION OF THE INVENTION

According to the present invention, a boat having a planing type hull is provided twin screws, both being driven by a single power plant or engine provided with an automatic, shiftable transmission. A throttle speed control is adjustable at the driver's compartment as well as a gear-change control. Preferably, an automatic transmission lever at the pilot's compartment will have at least two speeds and perhaps three speeds forward, one neutral position, one reversing position, and a lock position.

When the boat is starting from an essentially rest position, the operator puts in the low gear range the automatic transmission and then revs up the engine to approximately 5,000 rpm, for example. This reduces to moderate speed, but high torque, the action at the marine propellers which bite into the water and rapidly accelerate the boat forwardly, through increased propeller efficiency at its moderate-speed, high-torque level of operation. For water-ski boats of the length of from 17 to 26 feet, for example, the boat can achieve a planing condition, using a Chevrolet V-8 engine, in approximately 6 to 8 seconds.

Once a planing condition is achieved, then the engine speed is throttled back so as to reduce engine speed while at the same time the operator shifts forwardly to select a higher gear-ratio range relative to the automatic transmission. Accordingly, fuel consumption is drastically reduced both for the interval from standstill to planing condition, and likewise for cruising speed conditions.

OBJECTS

Accordingly, a principal object of the present invention is to provide a new and improved boat of the planing hull type and drive-system therefor.

A further object is to provide an improved drive for boats having planing hulls.

An additional objects is to provide in a boat a drive system including a single power plant or engine driving a pair of propeller shafts.

An additional object is to provide a drive system in the boat wherein the power plant is located proximate the transom of the boat.

A further object is to provide an engine, transmission combination, with controls to both, such that fuel consumption and time to achieve planing condition can be drastically decreased, and this with a drastic reduction in fuel consumption for cruising speeds selected.

The present invention contemplates boats having planing hulls with planing surfaces, the same where there are slight V-configurement or otherwise. In the art, planing type hulls are conspicuously dissimilar from displacement hulls that are used for large fishing boats and other craft.

The features of the present invention which are belived to be novel are set forth with particularity in the appended claims. The present invention, both as to its organization and manner of operation, together with further objects and advantages thereof, may best be understood by reference to the following description, taken in connection with the accompanying drawings in which:

IN THE DRAWINGS

DESCRIPTION OF PREFERRED EMBODIMENTS

Figure 1:
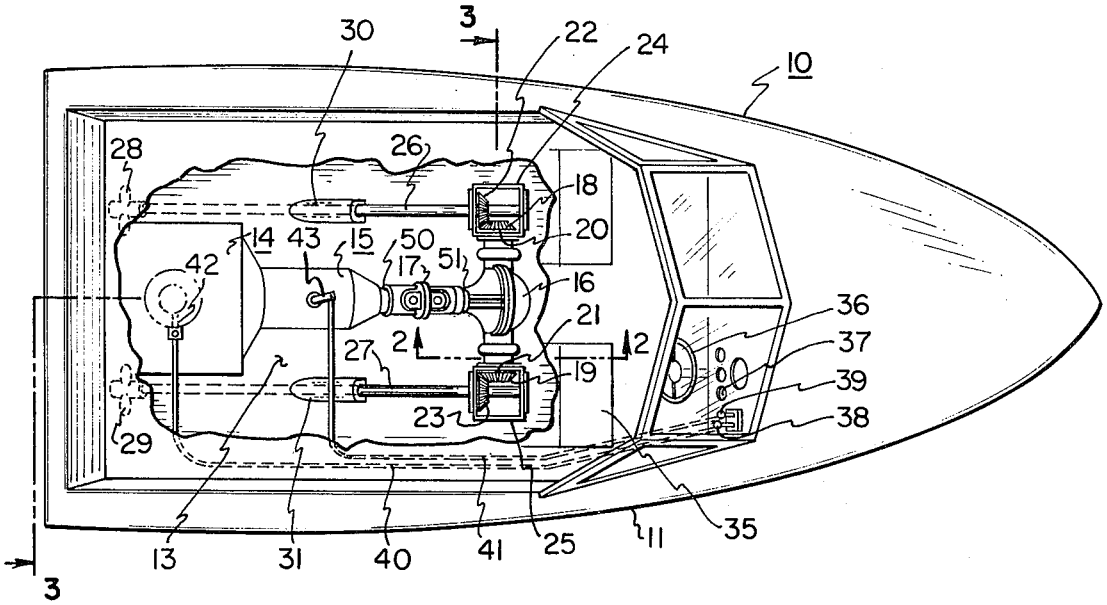
FIG. 1 is a top plan of a boat having a planing hull, with the power plant drive and transmission system contemplated by the present invention.
Figure 2:
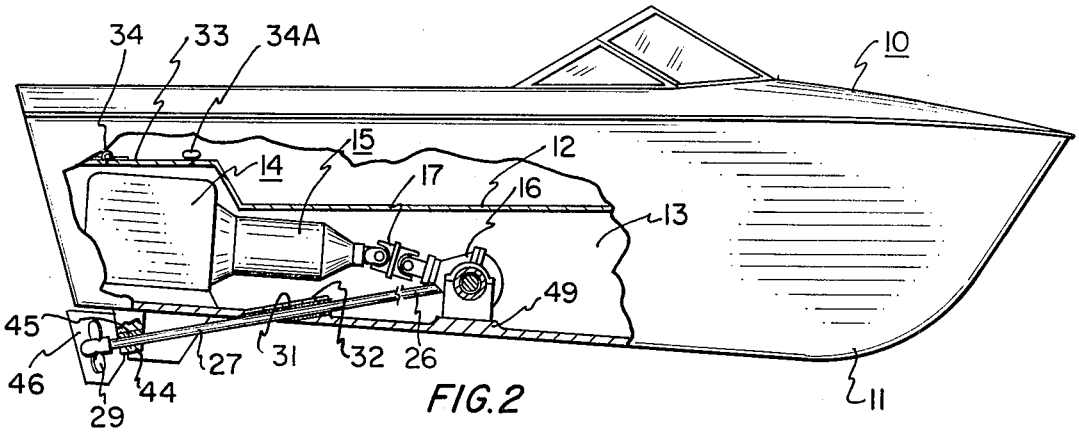
FIG. 2 is a side elevation of the structure shown in FIG. 1, and is broken away to show the mounting of the power plant, transmission and differential.
Figure 3:
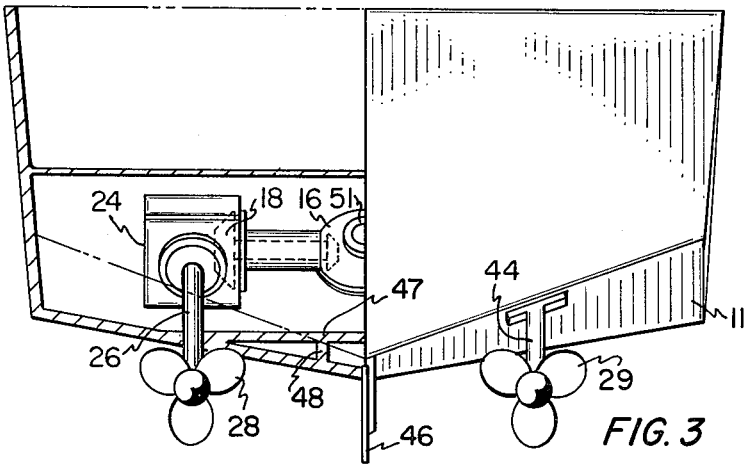
FIG. 3 is a end view of the boat at FIGS. 1 and 2, the lefthand side being broken away and sectioned to illustrate the location of a representative gear box, propeller shaft and propeller of the drive system of the boat.

As shown in FIGS. 1–3, boat 10 includes a planing-type hull 11 and a deck 12 secured thereto and defining an enclosure 13. Enclosure 13 contains inboard engine 14 mounted on the central longitudinal axis of the hull and having its output shaft on said axis to be coupled to an automobile-type automatic transmission 15 also mounted on said axis. Automobile-type differential 16, aligned with the engine and the transmission on the central longitudinal axis, is coupled to transmission 15 by a conventional, double-U-joint structure 17. Bevel gears 18 and 19 are fixed to the opposite stub shafts 20 and 21 of differential 16 and respectively mesh with bevel gears 22 and 23 to form right angle drive units. These latter bevel gears are contained within gear housings 24 and 25 and are respectively pinned to shafts 26 and 27. Marine propellers 28 and 29 are keyed to shafts 26 and 27, and the shafts themselves are journaled in packing gland structures 30 and 31 of conventional design. The packing gland structures form a part of hull bosses 32, one being shown in FIG. 2. An access door 33 is hinged at 34; pull 34A gives access to the engine 14 as illustrated. At the operator's position at 35 will be the conventional steering wheel 36, suitable gauges and controls at 37 and also a gas feed control 38 and automatic shifting lever 39. Control cables 40 and 41, coupled to controls 42, 43, are respectively attached to the levers 39 and 38, and lead to engine 14 and transmission 15 for respectively regulating the gas-feed of the engine and also low-range, high-range(s), reverse, neutral, and lock positions relative to transmission 15. Engine gas feed control 42 and transmission shifting control 43 are illustrated generically in FIG. 1 and as is customary supply the engine and transmission. A depending flange 44 includes appropriate bearing means 45 for receiving each of the respective shafts 27, 28. Rudder 46 is conventional and will not be elaborated upon; it will be understood that the rudder will be pivoted in the usual manner to the boat proximate and beneath the hull and has suitable control structure leading to steering wheel 36 and the rudder control shaft to which the latter is keyed. Bottom flooring 47, with the usual support structure 48, may be supplied in the usual manner. Differential 16 itself is secured to and/or supported by riser 49 of the hull 11.

In practice, the differential 16 can be a conventional automotive differential with the opposite shafts thereof being foreshortened and the spider gears thereof, welded together or otherwise secured so that there will not be slippage as between the two shafts. The gearing within the differential is strictly conventional, forms no part of the invention, and is well known in the art. For convenience of illustration, the cables 40 and 41 in their attachment to the controls of engine 14 and transmission 15 are not shown in FIG. 2.

It will be understood that it is possible to substitute, for the differential, appropriate belt drives to transmit power from the transmission output shaft 50, connected through double-U-joint 17 to center differential shaft 51, to the two output shafts 26 and 27. However, the already-enclosed gear and energy transfer mechanism of the differential 16 with its opposite shafts is deemed preferred.

In operation, the user, of course, controls the speed of engine 14 by throttle lever control 38. The transmission range, or reverse, is selected by the operator actuating appropriately shifting lever 39.

For rapid acceleration of the boat to a planing condition, a low range will be selected by the operator appropriately moving lever 39. Thereafter, the gas feed lever is moved to place the engine in a high speed condition and, by virtue of the low range selected for transmission 15, a moderate-speed high-torque condition will be applied to the differential shaft 51. This is immediately translated to the output shafts 26 and 27, such that marine propellers 28 and 29 turn quite rapidly, but at high torque, for accelerating to an on plane-condition planing hulls of up to 26 or 28 feet in length. A planing condition can be achieved in as little as 6 or 8 seconds from dead-start. To achieve cruising speed, the transmission will be shifted to a medium or high range and the throttle dropped back so that fuel is conserved.

By way of example, if a Chevrolet vehicle V-8 engine is used as the prime mover, i.e., at engine designation 14, then the automatic transmission would be shifted into low range and the engine revved to 5,000 rpm for example. This would push a 15–26' boat, having a planing hull, up on plane in 6 to 8 seconds, whereas for a standard high-gear boat or direct-drive boat, there would be required approximately 15 to 20 seconds to achieve a planing condition.

Another great advantage is the fact that fuel costs and consumption is reduced not only during the initial acceleration stage wherein a planing condition is rapidly achieved by the invention herein, but also for cruising speeds on plane wherein the engine can be throttled back and the transmission shifted to a higher range. It is estimated that fuel consumption can be reduced by approximately $\frac{1}{3}$ for boats having planing hulls in using the concept of the present invention.

Note is to be made that since the engine is immediately proximate the rear of the boat, a good weight distribution is achieved, with a majority of the weight being at the aft end of the boat.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. A planing-hull type boat including, in combination a planing-type hull having a transom;

an engine mounted in said hull adjacent to said transom, with a output shaft of said engine extending forwardly of said engine and away from said transom and with the engine being positioned essentially on a longitudinal axis through the said hull;

a propeller drive shaft positioned between the engine and each sidewall of the hull, each said drive shaft extending through a rear portion of the hull and each drive shaft extending in the hull to a location forwardly of the output shaft of said engine;

a propeller on the end of each drive shaft extending through the rear portion of the hull; and means interconnecting the output shaft and the other ends of each of the propeller drive shafts whereby rotation of the output shaft will cause opposite rotations of the propellers on the ends of the propeller shafts, said means including a differential on the longitudinal axis through the hull and connected through an automative transmission positioned forwardly of the engine and coupled to the engine and to the output shaft of the engine, and right angle drives between output shafts of the differential and the propeller drive shaft.

2. A boat as in claim 1 wherein the means interconnecting the output shaft and the other ends of each of the propeller drive shafts further comprises a double U-joint interconnecting the transmission and the differential.

3. A boat as in claim 1, wherein the transmission is an automatic transmission.

* * * * *